US005914153A

United States Patent [19]

Swink et al.

[11] Patent Number: 5,914,153

[45] Date of Patent: Jun. 22, 1999

[54] LIQUID COATING APPARATUS AND SYSTEM FOR CLEANING ROTARY COATING APPLICATOR THEREOF WITHOUT INTERRUPTION OF COATING PROCESS

[75] Inventors: Miles Glenn Swink, Goldsboro; Robert C. Shaw, Durham, both of N.C.; Richard T. Jones, III, Jarratt, Va.

[73] Assignee: Georgia-Pacific Corporation, Atlanta, Ga.

[21] Appl. No.: 08/914,122

[22] Filed: Aug. 19, 1997

[51] Int. Cl.[6] ..... B05D 1/02; B05B 7/16; B05C 3/00

[52] U.S. Cl. ..... 427/242; 427/421; 118/302; 118/308; 118/418; 134/33; 239/110

[58] Field of Search ..... 427/242, 421, 427/180; 134/6, 7, 94.1, 151, 153, 198, 199, 32, 33; 118/302, 308, 418, 19; 99/467, 468, 516; 366/219, 220; 451/328; 239/106, 110, 112, 1

[56] References Cited

U.S. PATENT DOCUMENTS 3,749,315 7/1973 Crathern .
4,214,708 7/1980 Lacchia .
4,275,838 6/1981 Fangmeyer .
4,380,321 4/1983 Culbertson et al. .
4,505,430 3/1985 Rodgers et al. .
4,887,770 12/1989 Wacker et al. .
5,358,182 10/1994 Cappeau et al. .

*Primary Examiner*—David A. Simmons
*Assistant Examiner*—Calvin Padgett
*Attorney, Agent, or Firm*—Banner & Witcoff, Ltd.

[57] ABSTRACT

A resin application apparatus used in the production of oriented strand board has a rotary atomizer supported within a drum for containing and tumbling wood flakes. A spinning cup is rotatably supported by a housing of the atomizer, with a gap formed between an outer surface of the cup and the housing. A supply line provides resin to the spinning cup for atomization thereof and coating of the tumbling wood flakes. A passageway is formed in the housing terminating in an outlet proximate the spinning cup. Solvent is flowed through the passageway and out of the outlet, sweeping away any accumulated material in the gap and on the spinning cup and housing. The cleaning operation is performed simultaneous with the flow and atomization of the resin, whereby the resin application process continues without interruption.

38 Claims, 3 Drawing Sheets

LIQUID COATING APPARATUS AND SYSTEM FOR CLEANING ROTARY COATING APPLICATOR THEREOF WITHOUT INTERRUPTION OF COATING PROCESS

FIELD OF THE INVENTION

The present invention relates to liquid coating apparatus, and, more particularly, to a cleaning system for a rotary coating applicator (atomizer) thereof.

BACKGROUND OF THE INVENTION

Rotary liquid atomizing spray apparatus are well known for coating objects and materials. Such apparatus typically comprise a spinning member such as a cup or disk which rotates at a high rate of speed in order to atomize liquid material which is pumped thereto. A frequent problem with such devices is the accumulation of matter on the spinning member, on its housing, and between the spinning member and the housing, which decreases the efficiency and operability of the device. Excess material on the spinning member can cause operational problems such as increased drag, higher amperage motor requirements, and motor burnout, each of which increases costs and reduces productivity.

U.S. Pat. No. 4,887,770 to Wacker et al. shows a device for applying a liquid coating material via atomization, the device having a bore with an exit port through which a cleaning solvent is directed to cleanse the exterior of a spinning cup. A separate passage is provided for directing cleaning solvent to the interior of the spinning cup. This cleaning process is carried out between color changes of the coating material; the atomizing device is not operational while it is cleaned.

U.S. Pat. No. 4,505,430 to Rodgers et al. shows a device for cleaning a rotary atomizer. Solvent is delivered to the nose region of an atomizer cup via a passageway in the housing. This cleaning process is carried out with the coating apparatus deactivated and with no object to be coated before the atomizer.

Other coating devices are known which atomize material via spinning cups or other members. Heretofor, such coating apparatus and processes have required periodic interruption of the coating process to perform cleaning operations on the associated rotary atomizer(s).

SUMMARY OF THE INVENTION

In view of the foregoing, it is an object of the present invention to provide a cleaning system which reduces or wholly overcomes some or all of the aforesaid difficulties inherent in prior known rotary coating applicators. It is a more specific object of the present invention to provide a resin application system including a rotary atomizer capable of being cleaned without interrupting the resin application process.

In accordance with a first aspect of the invention a liquid coating apparatus comprises a container for housing material to be coated, and a rotary coating applicator supported within the container. The applicator comprises a housing and a rotatable member supported by the housing. A gap is formed between an outer edge of the rotating member and the housing. A coating material supply line supplies coating material to the rotating member and the rotating member atomizes the coating material for application to the material housed in the container. A solvent supply line has an outlet formed in the housing proximate the rotating member, and the solvent is dischargeable from the outlet into the gap and onto the rotating member. A control means allows intermittent discharge of solvent from the outlet while the coating material is being supplied to and atomized by the rotating member.

In accordance with another aspect of the invention, the solvent used is water which mixes well with the resin, which is generally water soluble. Substantial advantage is achieved by providing such a spinning cup cleaning system. In particular, there is no need to shut down the device in order to cleanse it with solvent. The solvent can be sprayed while the spinning cup is atomizing resin, without adverse effects on the production process. This is highly advantageous since it eliminates the need to shut down the production process in order to clean the spinning cup and its surrounding gap. By cleansing the device during production, more frequent cleanings can be provided, resulting in greater operational efficiency as well as reduced maintenance and operating costs.

In accordance with another aspect of the invention, a coating apparatus for applying resin to wood flakes to form oriented strand board comprises a rotatable drum for containing and tumbling wood flakes to be coated and a rotary coating applicator supported within the drum. The applicator comprises a housing and a rotatable member supported by the housing. A resin supply line supplies resin to the rotatable member and the rotatable member serves to atomize the resin for coating the wood flakes. A solvent supply line has an outlet formed in the housing proximate the rotating member. Solvent is provided to the supply line and discharged from the outlet to clean the rotatable member and surrounding surfaces of the housing. A control means allows intermittent discharge of solvent from the outlet while resin is being supplied to and atomized by the rotatable member.

In accordance with another aspect of the invention, a method is provided for cleaning a rotary coating applicator without interruption of a coating process. The applicator comprises a housing, a rotatable member supported on the housing, and a solvent supply line having an outlet proximate the rotatable member. The method comprises supplying coating material to the rotatable member for atomization thereof, flowing solvent through the supplyline simultaneous with the supplying of coating material, and discharging solvent from the outlet across a gap between the rotatable member and the housing and onto the rotatable member while the rotatable member is spinning and the coating material is being thereby atomized.

In accordance with yet another aspect of the invention, a method is provided for applying resin to wood flakes for forming oriented strand board with a resin coating apparatus. The apparatus comprises a tumbling drum and a rotary coating applicator supported within the drum, and the applicator is cleaned while it is operational. The applicator comprises a housing, a rotatable member supported by the housing, and a solvent supply line having an outlet proximate the spinning cup. The method comprises tumbling wood flakes in the drum, supplying resin to the rotatable member whereby the resin is atomized and dispersed within the drum and onto the wood flakes, flowing solvent through the solvent supply line simultaneous with the supply of resin, and discharging solvent from the outlet across a gap between the rotatable member and the housing onto the rotatable member while the rotatable member is spinning and the coating material is being thereby atomized.

In accordance with another aspect of the invention, a coating apparatus for for applying resin to wood flakes to form oriented strand board comprises a drum for containing and tumbling wood flakes to be coated and a rotary coating applicator supported within the drum. The applicator comprises a housing and a rotatable member supported by the housing. A resin supply line supplies resin to the rotatable member and the rotatable member serves to atomize the resin for coating wood flakes within the drum. A solvent supply line has a first outlet proximate the a flared exterior surface of the rotatable member and a longitudinal axis substantially perpendicular to the flared exterior surface of the rotatable member. A second outlet of the supply line is proximate an upper rim of the rotatable member and has a longitudinal axis substantially parallel to a plane of rotation of the rotatable member. A control means allows for the intermittent discharge of solvent from the outlet while the spinning cup is atomizing resin.

Those skilled in the art will appreciate that the cleaning system of the present invention can provide significant increases in productivity and reductions in expenses in industrial coating processes, e.g., resin application in the manufacture of oriented strand board (OSB). These and additional features and advantages of the invention will be readily apparent and fully understood from the following detailed description of preferred embodiments, taken with reference to the appended drawings.

Figure 1:
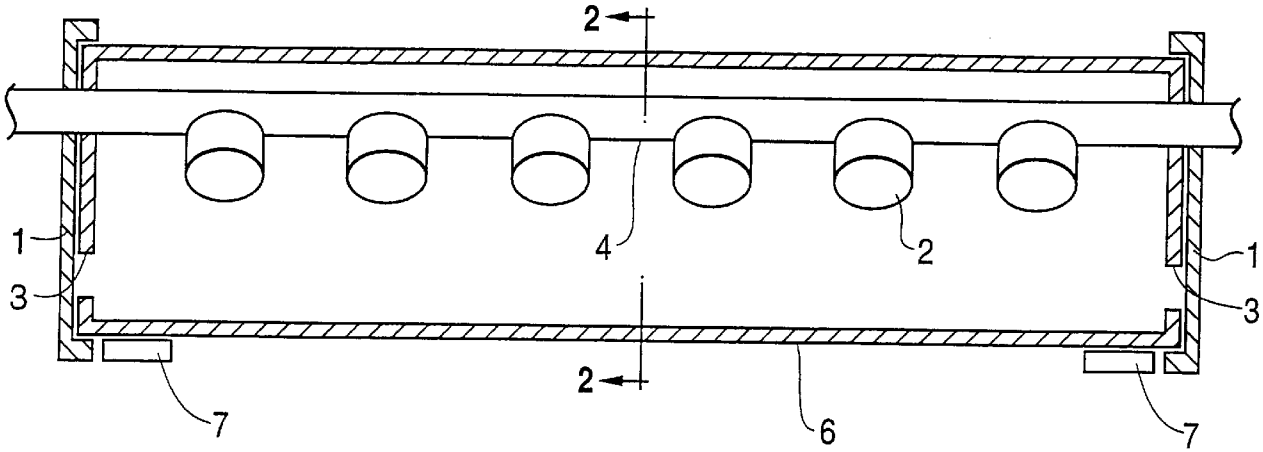
FIG. 1 is a schematic section view, shown partially broken away (fins shown in FIG. 2 are omitted for clarity), of a resin application apparatus in accordance with the present invention, for use in the manufacture of OSB.

It will be understood that the figures referred to above are not necessarily drawn to scale and present a representation of the invention illustrative of the principles and preferred features thereof. The same reference numbers are used in the drawings for similar or identical components and features shown in various alternative embodiments.

DETAILED DESCRIPTION OF CERTAIN PREFERRED EMBODIMENTS

Rotary atomizers are used in the manufacture of oriented strand board (OSB), among other products. OSB is formed of wood flakes which are covered with resin and subsequently bonded into a sheet. The resin is typically applied to the flakes in a continuous process with a rotary atomizer as the flakes are tumbled in a rotating drum. The principles of the invention may be used to advantage to clean the spinning cup or disk of such a rotary coating applicator, while the applicator is operational.

As shown in FIG. 1, a coating apparatus in accordance with the present invention, used in the production of OSB, comprises a plurality of atomizers 2 supported by a header 4 within a tumbling drum 6. In a preferred embodiment, drum 6 has a length of approximately 30 feet and a diameter of approximately 10 feet. Drum 6 is supported at each end by pairs of rollers 7 which allow drum 6 to rotate about its longitudinal axis, thereby tumbling and mixing the contents of drum 6. Header 4, which is preferably a steel pipe, extends through annular slots 3 formed in each end of drum 6 and is supported by stationary end caps 1. Header 4 thus remains stationary as drum 6 rotates. End caps 1 prevent the escape of material through the annular slots as drum 6 rotates. Drum 6 is preferably made of steel, having a liner formed of plastic which reduces the amount of resin which may accumulate on the interior of drum 6, and which allows accumulated material to be rinsed away.

Figure 2:
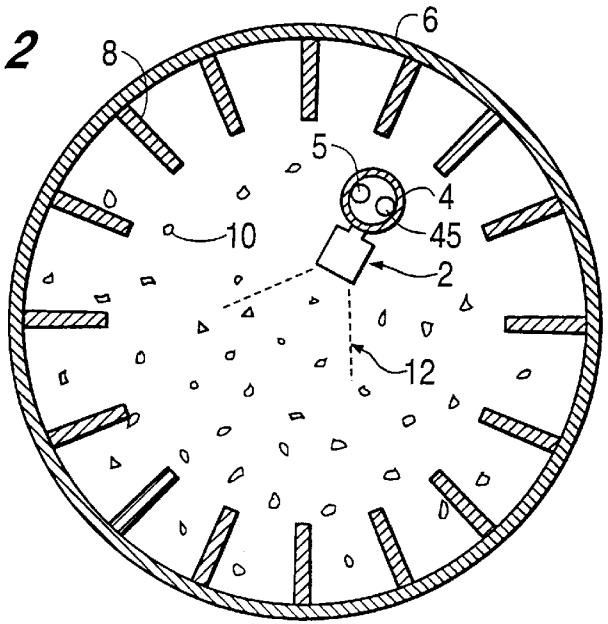
FIG. 2 is a schematic section view of the resin application apparatus taken along line 2—2 of FIG. 1.

As can be seen in FIG. 2, fins 8 extend radially inwardly from the interior surface of drum 6. Wood flakes 10 are preferably continuously loaded into one end of drum 6 and continuously removed from the opposite end via access doors. A conveying system (not shown) continuously monitors the quantity of wood flakes entering drum 6. Wood flakes are mixed (tumbled) by fins 8 as drum 6 rotates. A resin coating material is fed through conduit 5 provided in header 4 to atomizers 2. The resin is atomized and projected in a spray pattern, shown by dashed lines 12, into drum 6, thereby coating wood flakes 10 as they are tumbled. In the illustrated preferred embodiment, header 4 is offset from the central axis of drum 6 so that the atomized resin 12 is projected through the center portion of drum 6. The amount of resin 12 projected onto wood flakes 10 may vary and is controlled based, e.g., on the quantity of wood flakes 10 contained within drum 6.

In a preferred embodiment, six atomizers 2 are provided in tumbling drum 6 in order to evenly deposit resin 12 on wood flakes 10 along the length of the drum. The number of atomizers 2 in drum 6 may vary depending on various known operational factors.

Figure 3:
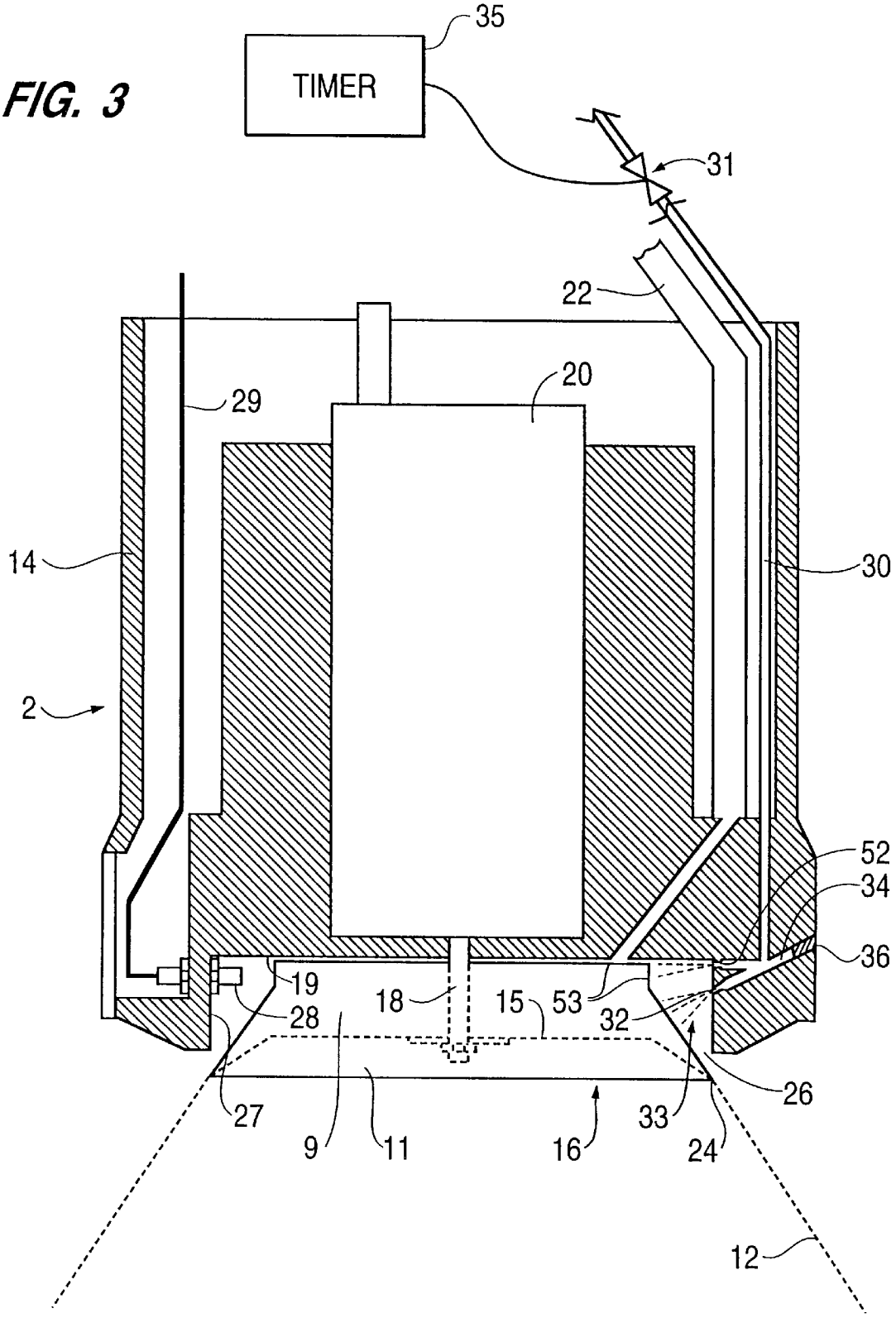
FIG. 3 is a schematic sectional view of a spinning cup atomizer included in the apparatus of FIG. 1.

Atomizer 2 comprises a housing 14, as seen in FIG. 3. Housing 14, in a preferred embodiment, is machined from a cylindrical block of aluminum. A rotatable member such as a cup 16, is supported by a rotatable shaft 18, driven by a motor 20. Cup 16 is housed within a recess 19 formed in the bottom of housing 14. In a preferred embodiment, motor 20 is a 2 HP motor, and cup 16 is model No. 2-EL4-0, supplied by Coil Industries Ltd., of White Rock, British Columbia, Canada.

Figure 4:
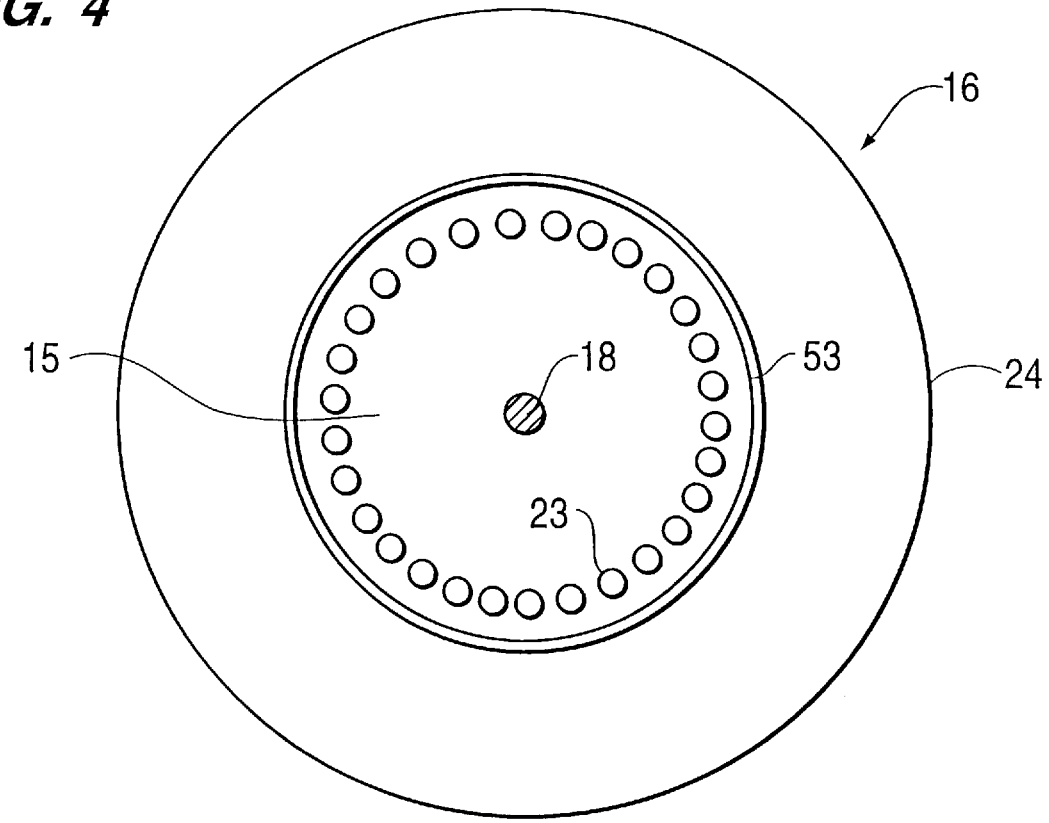
FIG. 4 is a schematic top plan view of the spinning cup included in the atomizer of FIG. 3.

Supply line 22 is provided in housing 14, connected at a first end via conduit 5 extending within header 4 to a reservoir (not shown) of suitable resin 12. Its second end terminates in housing 14 proximate upper rim 53 of cup 16. Upper rim 53 is preferably spaced approximately ⅛ inch from the upper surface of recess 19. Floor surface 15 divides cup 16 into upper region 9 and lower region 11. Resin 12 travels through supply line 22 and enters upper region 9 of cup 16. Holes 23 formed in floor surface 15, as seen in FIG. 4, allow resin 12 to pass into lower region 11. Cup 16 rotates at a very high speed, typically in the range of 10,000 to 11,000 rpm. Centrifugal force carries resin radially outwardly along the bottom surface of floor surface 15, downwardly along the flared interior surface of cup 16 and projects it outwardly from lower rim 24 of cup 16 in a spray pattern (shown by dashed lines 12).

Gap 26 is formed between the outer surface of cup 16 and an interior surface 27 of recess 19. In operation, a vortex is created by the rotation of cup 16, causing a portion of resin 12 and particles from wood flakes 10 to accumulate within gap 26. Over time, the accumulation of such material within gap 26 can create drag on cup 16, putting strain on motor 20 and resulting in higher amperage motor requirements and motor burnout, each of which increases costs and reduces productivity. Additionally, such material can accumulate on other devices such as speed sensor 28, which is located within gap 26 and connected to monitoring equipment (not shown) by cable 29. Speed sensor 28 monitors the rotational speed of cup 16 and its operation can be hindered if resin and/or wood flake particles cover or partially cover its surface.

Supply line 30 is provided in housing 14 with a first end being connected to a valve 31 and a second end terminating in outlets 32, 52 formed in housing 14, which open into gap 26 proximate cup 16. Supply line 30 may comprise a passageway formed in the housing connected to a supply hose 45 (seen in FIG. 2) extending within header 4 and connected to a reservoir (not shown) of solvent. Valve 31 may be located in supply hose 45 upstream of header 4. Solvent (shown by dashed lines 33) is supplied into supply line 30 and discharged from outlet 32 across gap 26 onto the angled outer surface of cup 16. In a preferred embodiment, outlet 32 is located adjacent, and has an axis which is substantially perpendicular to, the flared outer surface of cup 16. Outlet 32 is preferably spaced approximately ½ inches from the flared exterior surface of cup 16. Solvent 33 is discharged substantially parallel to the plane of rotation of cup 16 from outlet 52, located adjacent upper rim 53. The spray is directed across gap 26 onto and above upper rim 53, thereby cleaning upper rim 53 and the area between upper rim 53 and the upper surface of recess 19. Outlet 52 is preferably spaced approximately 1 inch from upper rim 53 of cup 16.

The flow of solvent 33 through outlets 32, 52 is regulated by valve 31 which is controlled manually, or, in a preferred embodiment, is a control valve operated automatically by a timing mechanism such as timer 35. Solvent 33 impinges on cup 16, thereby removing any accumulated resin 12 and/or wood flake particles from cup 16. The vortex created by the rotation of cup 16 carries solvent 33 around the exterior of cup 16, thereby cleaning the surface of recess 19 as well, whereby gap 26 is left unobstructed. This cleaning process reduces drag imposed on cup 16 due to accumulated material. It also removes material from speed sensor 28, thereby improving the efficiency and operation of atomizer 2.

A unique feature of the present invention is its ability to perform a cleaning operation without interruption of the continuous coating process, i.e., while atomization of resin 12 is taking place. There are significant cost savings and productivity gains associated with being able to simultaneously operate and clean atomizer 2. In a typical production environment, an atomizer would need to be shut down approximately three times in every working shift in order to clean out the accumulated material and restore the operational efficiency of the atomizer. Each of these shut downs results in lost production.

A key to allowing the cleaning to occur without interrupting or adversely affecting the coating operation is controlling the amount and rate at which solvent 33 is discharged from outlets 32, 52 relative to the amount of resin 12 supplied to spinning cup 16. Excessive flow of solvent relative to the resin flow can adversely affect the coating operation by excessively diluting the resin. It can also adversely produce higher amperage motor requirements. The flows of resin 12 through supply line 22, and of solvent 33 through supply line 30, are preferably each limited to no more than approximately 2 gallons per minute. In a preferred embodiment, approximately ¼ gallons per minute of resin 12 is flowed through supply line 22, and approximately 2 gallons per minute flows through supply line 30 of each atomizer 2. Therefore, in the illustrated embodiment, approximately 1½ gallons per minute of resin 12 will be discharged by the combination of all six of the atomizers 2 in drum 6. Solvent 33 is preferably discharged from one atomizer 2 at a time. The six atomizers 2 may be cleaned sequentially so that a maximum of approximately 2 gallons per minute of solvent 33 is discharged for approximately one minute into drum 6 at 10 minute intervals.

In a preferred embodiment, supply line 30 preferably has a diameter of approximately ¼ inches. Outlets 32, 52 preferably have smaller diameters of approximately ⅛ inches to increase the flow velocity of solvent 33.

In a preferred embodiment, the solvent is water which mixes well with the water soluble resin typically used in OSB manufacture. Resin 12 is preferably a phenol formaldehyde, such as Resi-Strand manufactured by Georgia-Pacific. In a preferred embodiment of the present invention, solvent 33 is directed through outlets 32, 52 twice a shift for a duration of approximately one minute, without interrupting the resin flow and atomization. These cleanings provide the aforementioned benefits without adversely affecting the continuous wood flake coating operation.

A cleanout or cleaning bore 34 extends from an outer surface of housing 14 to supply line 30 and is coaxial with at least the portion of supply line 30 comprising outlet 32. To clean outlet 32 of any accumulated material, a flushing material, such as water, is forced through cleaning bore 34 and outlet 32. Plug 36, such as a set screw or other suitable means, is inserted into the outer end of cleaning bore 34 to sealingly engage cleaning bore 34 and prevent leakage of solvent 33.

Figure 5:
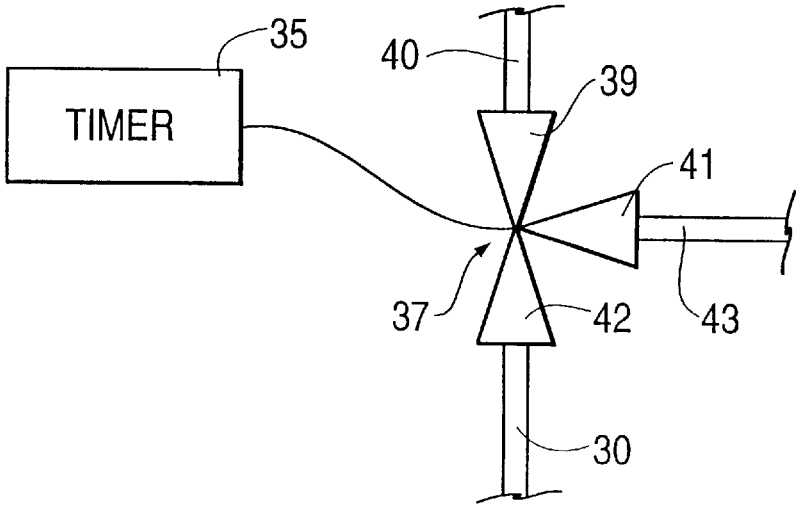
FIG. 5 is a schematic view of an alternative embodiment of the control means associated with the atomizer of FIG. 3.

In an alternative embodiment, as seen in FIG. 5, a three way valve 37 is placed in supply line 30. Obviously, valve 37 may be placed in supply hose 45 upstream of header 4. First port 42 of valve 37 is connected to supply line 30. Second port 41 of valve 37 is connected to a supply of compressed air (not shown) via air hose 43. Third port 39 of valve 37 is connected to a reservoir (not shown) of solvent 33 via supply line 40. During times when solvent 33 is not supplied through supply line 30 to outlet 32, third port 39 is closed and second port 41 is opened, allowing air to flow through to supply line 30 and exit outlet 30 into gap 26. This stream of air acts to reduce the accumulation of resin 12 and particles of wood flakes 10 in gap 26, on cup 16, and on housing 14 by counteracting the effect of the vortex produced by the rotation of cup 16. In a preferred embodiment the air is supplied through supply line 30 at a pressure of approximately 5 pounds per square inch. To clean atomizer 2, second port 41 is closed and third port 39 is opened, thereby restoring the flow of solvent 33 for a desired interval. The operation of valve 37 can be controlled manually. Alternatively, in a preferred embodiment, valve 37 is a control valve operated automatically by a timing mechanism such as timer 35. Such automatic operation will assure consistent cleanings at the proper intervals and avoid the need for manual intervention thereby further improving the quality and efficiency of the coating operation.

In light of the foregoing, those skilled in this area of technology will readily understand that various modifications and adaptations can be made without departing from the scope and spirit of the invention defined in the appended claims. It will be understood that rotary coating applicators in accordance with the invention will have specific configurations and components determined largely by the intended application and environment in which they are used.

We claim:

1. A method of applying resin to wood flakes for forming oriented strand board with a resin coating apparatus comprising a tumbling drum and a rotary coating applicator supported within the drum, and cleaning the applicator while it is operational, the applicator comprising a housing, a rotatable member supported by the housing, and a solvent supply line having an outlet proximate the rotatable member, the method comprising:

tumbling wood flakes in the drum;

supplying resin to the rotatable member whereby the resin is atomized and dispersed within the drum and onto the wood flakes;

flowing solvent through the solvent supply line simultaneous with said supplying of resin; and discharging solvent from the outlet across a gap between the rotatable member and the housing onto the rotatable member while the rotatable member is spinning and the coating material is being thereby atomized.

2. A method of applying resin in accordance with claim 1, wherein the resin is water soluble resin and the solvent comprises water.

3. A method of applying resin in accordance with claim 2, wherein the resin is supplied at a rate of approximately ¼ gallons per minute, and the solvent is discharged at a rate of approximately 2 gallons per minute.

4. A method of cleaning a rotary coating applicator in accordance with claim 3, wherein the solvent is discharged into the gap at predetermined intervals during atomization of the coating material.

5. A method of applying resin in accordance with claim 4, further comprising the step of directing air through the passageway and out of the outlet between the intervals in which solvent is discharged into to the gap.

6. A method of applying resin in accordance with claim 5, wherein the air is directed through the passageway at a pressure of approximately 5 psi.

7. A method of cleaning a rotary coating applicator without interruption of a coating process, the applicator comprising a housing, a rotatable member supported on said housing, and a solvent supply line having an outlet proximate the rotatable member, the method comprising:

supplying coating material to the rotatable member for atomization thereof;

flowing solvent through said supply line simultaneous with said supplying of coating material; and discharging solvent from the outlet across a gap between the rotatable member and the housing and onto the rotatable member, while the rotatable member is spinning and the coating material is being thereby atomized.

8. A method of cleaning a rotary coating applicator in accordance with claim 7, wherein the coating material is water soluble resin and the solvent comprises water.

9. A method of cleaning a rotary coating applicator in accordance with claim 8, wherein the coating material is supplied at a rate of approximately ¼ gallons per minute and the solvent is discharged at a rate of approximately 2 gallons per minute.

10. A method of cleaning a rotary coating applicator in accordance with claim 7, wherein the solvent is discharged into the gap at predetermined intervals during atomization of the coating material.

11. A method of cleaning a rotary coating applicator in accordance with claim 10, wherein air is flowed through the passageway and discharged from the outlet between the intervals in which solvent is discharged into the gap.

12. A liquid coating apparatus, comprising:

a container for housing material to be coated; and a rotary coating applicator supported within the container, said applicator comprising:

a housing;

a rotatable member supported by the housing, a gap being formed between an outer edge of the rotating member and the housing;

a coating material supply line for supplying coating material to the rotating member, the rotating member serving to atomize the coating material for application to the material housed in the container;

a solvent supply line having an outlet formed in the housing proximate the rotating member, the solvent being dischargeable from the outlet into said gap and onto the rotating member; and control means for allowing intermittent discharge of solvent from the outlet while the coating material is being supplied to and atomized by the rotating member.

13. A liquid coating apparatus in accordance with claim 12, wherein the control means comprises a manual valve disposed in the solvent supply line.

14. A liquid coating apparatus in accordance with claim 12, wherein the control means comprises a control valve disposed in the solvent supply line and a timing mechanism to automatically open and close the control valve at predetermined intervals.

15. A liquid coating apparatus in accordance with claim 12, wherein the control means comprises a three-way valve, a first port thereof connected to the solvent supply line, a second port thereof being connected to an air supply, and a third port thereof being connected to a solvent supply, the second port being open to supply air to the solvent supply line when the third port is closed and the third port being open to supply solvent to the solvent supply line when the second port is closed.

16. A liquid coating apparatus in accordance with claim 15, wherein the air is supplied at a pressure of approximately 5 psi.

17. A liquid coating apparatus in accordance with claim 15, wherein said three-way valve is a control valve, said apparatus further comprising a timing mechanism to automatically regulate operation of the control valve.

18. A liquid coating apparatus in accordance with claim 12, wherein the outlet has a diameter of approximately ⅛ inch.

19. A liquid coating apparatus in accordance with claim 12, wherein first and second outlets are provided, the first outlet being adjacent a flared exterior surface of the rotatable member and having a longitudinal axis substantially perpendicular to said flared exterior surface, the second outlet being adjacent an upper rim of the cup and having a longitudinal axis substantially parallel to a plane of rotation of the rotatable member.

20. A liquid coating apparatus in accordance with claim 12, further comprising a cleaning bore connected to the solvent supply line, the cleaning bore providing access for flushing the outlet and a segment of the solvent supply line.

21. A liquid coating apparatus in accordance with claim 20, further comprising a plug sealingly insertable in the cleaning bore.

22. A liquid coating apparatus in accordance with claim 20, wherein the cleaning bore is coaxial with the outlet and a portion of the solvent supply line.

23. A liquid coating apparatus in accordance with claim 12, wherein the rotating member is a cup-shaped member.

24. A coating apparatus for applying resin to wood flakes to form oriented strand board, comprising:

a rotatable drum for containing and tumbling wood flakes to be coated; and a rotary coating applicator supported within the drum, said applicator comprising:

a housing;

a rotatable member supported by the housing;

a resin supply line for supplying resin to the rotatable member, therotatable member serving to atomize the resin for coating said wood flakes;

a solvent supply line having an outlet formed in the housing proximate the rotating member, whereby solvent provided to the supply line is discharged from the outlet to clean the rotatable member and surrounding surfaces of the housing; and control means for allowing intermittent discharge of solvent from the outlet while resin is being supplied to and atomized by the rotatable member.

25. A coating apparatus in accordance with claim 24, wherein the control means comprises a manual valve disposed in the solvent supply line.

26. A coating apparatus in accordance with claim 24, wherein the control means comprises a control valve disposed in the solvent supply line and a timing mechanism to automatically open and close the control valve at predetermined intervals.

27. A coating apparatus in accordance with claim 24, wherein the outlet has a diameter of approximately ⅛ inch.

28. A coating apparatus in accordance with claim 24, wherein first and second outlets are provided, the first outlet being adjacent a flared exterior surface of the rotatable member and having a longitudinal axis substantially perpendicular to said flared exterior surface, the second outlet being adjacent an upper rim of the cup and having a longitudinal axis substantially parallel to a plane of rotation of the rotatable member.

29. A coating apparatus in accordance with claim 24, wherein the control means comprises a three-way valve, a first port thereof connected to the solvent supply line, a second port thereof being connected to an air supply, and a third port thereof being connected to a solvent supply, the second port being open to supply air to the solvent supply line when the third port is closed and the third port being open to supply solvent to the supply line when the second port is closed.

30. A coating apparatus in accordance with claim 29, wherein said three-way valve is a control valve, said apparatus further comprising a timing mechanism to automatically regulate operation of the control valve.

31. A coating apparatus in accordance with claim 29, wherein the air is supplied at a pressure of approximately 5 psi.

32. A coating apparatus in accordance with claim 24, further comprising a cleaning bore connected to the passageway, the cleaning bore providing access for flushing the outlet and a segment of the solvent supply line.

33. A coating apparatus in accordance with claim 32, further comprising a plug sealingly insertable in the cleaning bore.

34. A coating apparatus for applying resin to wood flakes to form oriented strand board, comprising:

a drum for containing and tumbling wood flakes to be coated; and a rotary coating applicator supported within the drum, said applicator comprising:

a housing;

a rotatable member supported by the housing;

a resin supply line for supplying resin to the rotatable member, the rotatable member serving to atomize the resin for coating wood flakes within said drum;

a solvent supply line having a first outlet proximate a flared exterior surface of the rotatable member and having a longitudinal axis substantially perpendicular to said flared exterior surface of the rotatable member;

said supply line further having a second outlet proximate an upper rim of the rotatable member and having a longitudinal axis substantially parallel to a plane of rotation of the rotatable member; and control means for allowing intermittent discharge of solvent from the first and second outlets while the rotatable member is atomizing resin.

35. A coating apparatus in accordance with claim 34, wherein the control means comprises a manual valve disposed in the solvent supply line.

36. A coating apparatus in accordance with claim 34, wherein the control means comprises a control valve disposed in the solvent supply line and a timing mechanism to automatically open and close the control valve at predetermined intervals.

37. A coating apparatus in accordance with claim 34, wherein the first and second outlets each have a diameter of approximately ⅛ inch.

38. A coating apparatus in accordance with claim 34, wherein the first outlet is spaced from the flared exterior surface of the rotating member approximately ½ inch and the second outlet is spaced from the upper rim of the rotating member approximately 1 inch.

* * * * *

UNITED STATES PATENT AND TRADEMARK OFFICE

CERTIFICATE OF CORRECTION

PATENT NO. : 5,914,153
DATED : June 22, 1999
INVENTOR(S) : Miles G. Swink et al.

It is certified that error appears in the above-identified patent and that said Letters Patent is hereby corrected as shown below:

Column 7, claim 5,
Line 29, "passageway" should read -- solvent supply line --.

Column 7, claim 6,
Line 32, "passageway" should read -- solvent supply line --.

Column 7, claim 11,
Line 62, "passageway" should read -- solvent supply line --.

Column 8, claim 12,
Lines 3, 6, 10, 12, and 15, each occurrence of "rotating" should read -- rotatable --.

Column 8, claim 19,
Line 49, "cup" should read -- rotatable member --

Column 8, claim 23,
Line 63, "rotating" should read -- rotatable --.

Column 9, claim 24,
Line 6, "therotatable" should read -- the rotatable --.
Line 9, "rotating" should read -- rotatable --.

Column 9, claim 28,
Line 31, "cup" should read -- rotatable member --.

Column 10, claim 32,
Line 3, "passageway" should read -- solvent supply line --.

Signed and Sealed this

Eighteenth Day of December, 2001

*Attest:*

*Attesting Officer*

JAMES E. ROGAN
*Director of the United States Patent and Trademark Office*